US006470868B2

(12) United States Patent
Nakagawa et al.

(10) Patent No.: US 6,470,868 B2
(45) Date of Patent: Oct. 29, 2002

(54) ENGINE SELF-DIAGNOSIS APPARATUS AND CONTROL APPARATUS

(75) Inventors: Shinji Nakagawa; Minoru Ohsuga, both of Hitachinaka; Yutaka Takaku, Mito; Kouzou Katogi, Hitachi, all of (JP)

(73) Assignee: Hitachi, Ltd., Tokyo (JP)

( * ) Notice: Subject to any disclaimer, the term of this patent is extended or adjusted under 35 U.S.C. 154(b) by 24 days.

(21) Appl. No.: 09/811,565

(22) Filed: Mar. 20, 2001

(65) Prior Publication Data

US 2002/0022921 A1 Feb. 21, 2002

(30) Foreign Application Priority Data

Aug. 18, 2000 (JP) ..... 2000-248774

(51) Int. Cl.[7] ..... F02D 41/14

(52) U.S. Cl. ..... 123/673; 701/109; 701/114; 73/117.3; 123/690

(58) Field of Search ..... 123/673, 690; 73/117.3; 701/109, 114

(56) References Cited

U.S. PATENT DOCUMENTS 5,131,371 A * 7/1992 Wahl et al. ..... 123/436
5,131,372 A * 7/1992 Nakaniwa ..... 123/673
5,566,071 A * 10/1996 Akazaki et al. ..... 123/672
5,623,913 A * 4/1997 Kitajima et al. ..... 123/673

FOREIGN PATENT DOCUMENTS

JP 8-177575 7/1996
JP 8-270482 10/1996

* cited by examiner

*Primary Examiner*—Erick Solis
(74) *Attorney, Agent, or Firm*—Crowell & Moring LLP

(57) ABSTRACT

There is disclosed an apparatus in which changes of linear A/F sensor or engine response characteristics can be detected with high precision in a broad range during operation of an engine. The apparatus includes a controller 50 for controlling an air/fuel ratio of each cylinder of a multiple cylinder engine, and a linear A/F sensor 28 for emitting an output which is proportional to the air/fuel ratio of an exhaust tube assembly. The air/fuel ratio of a specific cylinder is changed by a predetermined amount, a vibration component amplitude or a frequency component based on an engine rotation number is extracted from a signal obtained from the linear A/F sensor 28, and the response characteristics of an air/fuel ratio detector or the engine are detected from the amplitude or a power of the frequency component.

17 Claims, 16 Drawing Sheets

ENGINE SELF-DIAGNOSIS APPARATUS AND CONTROL APPARATUS

BACKGROUND OF THE INVENTION

The present invention relates to a self-diagnosis apparatus and control apparatus of an engine (internal combustion engine) for use in vehicles such as a car, particularly to a self-diagnosis apparatus for self-diagnosing an abnormality of an air/fuel ratio detection apparatus, and a control apparatus.

In order to purify HC, CO, NOx in an exhaust gas exhausted from an engine, a three way catalytic converter has heretofore been attached midway in an exhaust passage. As shown in FIG. 20, the three way catalytic converter has characteristics that three components of HC, CO, NOx are purified only in the vicinity of a theoretical air/fuel ratio at a high efficiency.

Therefore, in an engine air/fuel ratio control system, as shown in FIG. 21, presence/absence of oxygen in the exhaust gas is detected by an $O_2$ sensor having output characteristics that a sensor output rapidly changes at the theoretical air/fuel ratio, and the air/fuel ratio is feedback-controlled based on an output of the $O_2$ sensor.

To further highly purify the exhaust gas, as an air/fuel ratio control system in which more precise air/fuel ratio control is possible, as shown in FIG. 22, a linear A/F sensor having linear output characteristics with respect to the air/fuel ratio (oxygen concentration of the exhaust gas) is employed to feedback-control the air/fuel ratio, and this system has spread.

In this air/fuel ratio control system, if the linear A/F sensor causes a trouble for some reason, and the output characteristics of the linear A/F sensor change, the precision of the feedback control to the theoretical air/fuel ratio is deteriorated, and the exhaust gas cannot sufficiently be purified. To solve the problem, a method and apparatus for detecting a change of the characteristics of the linear A/F sensor have heretofore been proposed.

One of conventional techniques of detecting the characteristics change of the linear A/F sensor is disclosed in Japanese Patent Application Laid-Open No. 177575/1996. In the technique, a sensor output change ratio of a point at which a fuel supply amount changes is obtained from a sensor output before and after a fuel amount supplied to the engine is changed during fuel cut starting or resetting, and it is judged based on the sensor output change ratio whether or not there is an abnormality in the linear A/F sensor.

Another technique is disclosed in Japanese Patent Application Laid-Open No. 270482/1996. In the technique, when a target air/fuel ratio shifts with a change of engine operation conditions, according to a result of comparison of a change amount of the target air/fuel ratio with the change amount of the sensor output, or a result of comparison of the change amount of the target air/fuel ratio with the change amount of a fuel injection correction amount, it is judged whether or not there is an abnormality in the sensor.

In actual, the characteristics of the air/fuel ratio control system are influenced by various disturbances, and dispersion exists in an output signal of the linear A/F sensor. Therefore, when frequency of diagnosis (judgment of presence/absence of abnormality) is little, sufficient diagnosis precision cannot be obtained in some cases.

On the other hand, in the aforementioned systems, the diagnosis is performed only in specific operation conditions such as during fuel cut or during change of the target air/fuel ratio, and it cannot be said that there are many diagnosis opportunities. Moreover, it cannot be said that any system is satisfactory in respect of diagnosis precision. Furthermore, when the change amount of the sensor output is calculated, the diagnosis is easily influenced by noise, and the diagnosis precision is supposedly similarly deteriorated.

SUMMARY OF THE INVENTION

The present invention has been developed to solve the aforementioned problem, and an object thereof is to provide a self-diagnosis apparatus which can detect a response characteristics change of a linear A/F sensor and an operation state of an engine in a short time in almost all operation conditions with high precision, and a control apparatus for appropriately controlling the operation state of the engine.

To achieve the aforementioned object, according to the present invention, there is provided an engine self-diagnosis apparatus comprising: means for controlling an air/fuel ratio of each cylinder of a multiple cylinder engine; air/fuel ratio detection means for emitting an output which is proportional to an air/fuel ratio of an exhaust tube assembly; means for controlling the air/fuel ratio of each cylinder to be non-uniform; and means for detecting response characteristics of the air/fuel ratio detection means or response characteristics of engine control from an amplitude of a signal obtained from the air/fuel ratio detection means under control under which the air/fuel ratio of each cylinder is non-uniform.

Thereby, a vibration of the air/fuel ratio of the exhaust tube assembly generated when the air/fuel ratio of each cylinder is set to be non-uniform is detected, and the response characteristics of the air/fuel ratio detection means or the response characteristics of the air/fuel ratio control system can be detected from the amplitude.

Moreover, the engine self-diagnosis apparatus of the present invention detects the response characteristics of the air/fuel ratio detection means or the response characteristics of the engine control from the signal amplitude based on an engine rotation number in response to the signal obtained from the air/fuel ratio detection means.

A cycle of the vibration of the air/fuel ratio in the exhaust tube assembly generated when the air/fuel ratio of each cylinder is set to be non-uniform depends on the engine rotation number. Therefore, the response characteristics of the air/fuel ratio detection means or the response characteristics of the engine control are detected from a signal component amplitude synchronized with the engine rotation number in response to the signal obtained from the air/fuel ratio detection means.

Moreover, the engine self-diagnosis apparatus of the present invention includes means for judging that the response characteristics of the air/fuel ratio detection means are abnormal when the amplitude of the signal obtained from the air/fuel ratio detection means indicates a predetermined value or less.

Furthermore, the engine self-diagnosis apparatus of the present invention detects a fuel property from the amplitude of the signal obtained from the air/fuel ratio detection means when the engine cools down.

When the engine cools down, the response characteristics possibly change in accordance with the fuel property. Therefore,when the response characteristics of the air/fuel ratio detection means are normal, it is judged that the response characteristics change during cool-down depends on the fuel property.

Moreover, according to the present invention, there is provided an engine self-diagnosis apparatus comprising:

means for controlling an air/fuel ratio of each cylinder of a multiple cylinder engine; air/fuel ratio detection means for emitting an output which is proportional to an air/fuel ratio of an exhaust tube assembly; means for controlling the air/fuel ratio of each cylinder to be non-uniform; and means for detecting response characteristics of the air/fuel ratio detection means or response characteristics of engine control from a frequency component of a signal obtained from the air/fuel ratio detection means under control under which the air/fuel ratio of each cylinder is non-uniform.

Thereby, the frequency component of a vibration of the air/fuel ratio of the exhaust tube assembly generated when the air/fuel ratio of each cylinder is set to be non-uniform is detected, and the response characteristics of the air/fuel ratio detection means or the response characteristics of the air/fuel ratio control system can be detected in accordance with a value of the frequency component.

Moreover, the engine self-diagnosis apparatus of the present invention detects the response characteristics of the air/fuel ratio detection means or the response characteristics of the engine control from the frequency component based on an engine rotation number in response to the signal obtained from the air/fuel ratio detection means.

A cycle of the vibration of the air/fuel ratio in the exhaust tube assembly generated when the air/fuel ratio of each cylinder is set to be non-uniform depends on the engine rotation number. Therefore, the response characteristics of the air/fuel ratio detection means or the response characteristics of the engine control are detected from a signal frequency component synchronized with the engine rotation number in response to the signal obtained from the air/fuel ratio detection means.

Moreover, the engine self-diagnosis apparatus of the present invention detects the response characteristics of the air/fuel ratio detection means or the response characteristics of the engine control from a power of the frequency component in a predetermined phase range based on the engine rotation number in response to the signal obtained from the air/fuel ratio detection means.

Since the air/fuel ratio of the exhaust tube assembly vibrates in synchronization with the engine rotation number, the power of the frequency component in the predetermined phase range based on the engine rotation number is proportional to a change amount of the air/fuel ratio applied only to a specific cylinder. However, when the response characteristics of the air/fuel ratio detection means are deteriorated, the amplitude of the air/fuel ratio of the assembly is reduced. Therefore, a proportionality factor of a proportionality of the air/fuel ratio change amount applied only to the specific cylinder to the power of the frequency component changes. Therefore, response deterioration of the air/fuel ratio detection means can be detected.

Moreover, the engine self-diagnosis apparatus of the present invention includes means for judging that the response characteristics of the air/fuel ratio detection means are abnormal when the power of the frequency component in the predetermined phase range based on the engine rotation number indicates a predetermined value or less in response to the signal obtained from the air/fuel ratio detection means.

Furthermore, the engine self-diagnosis apparatus of the present invention includes means for informing that the response characteristics of the air/fuel ratio detection means are judged to be abnormal.

Additionally, the engine self-diagnosis apparatus of the present invention detects a fuel property from the frequency component of the signal obtained from the air/fuel ratio detection means when the engine cools down.

When the engine cools down, the response characteristics possibly change in accordance with the fuel property. Therefore, when the response characteristics of the air/fuel ratio detection means are normal, it is judged that the response characteristics change during cool-down depends on the fuel property.

When it is judged that the response characteristics of the air/fuel ratio detection means are abnormal, control performed based on the signal obtained from the air/fuel ratio detection means is stopped.

Moreover, an engine control apparatus according to the present invention includes means for controlling an engine operation parameter based on response characteristics of air/fuel ratio detection means or response characteristics of engine control.

Thereby, variable gain control of PI control in a theoretical air/fuel ratio correction term calculator can be performed based on the response characteristics of the air/fuel ratio detection means or the response characteristics of the engine control.

DETAILED DESCRIPTION OF THE PREFERRED EMBODIMENTS

First Embodiment

Figure 1:
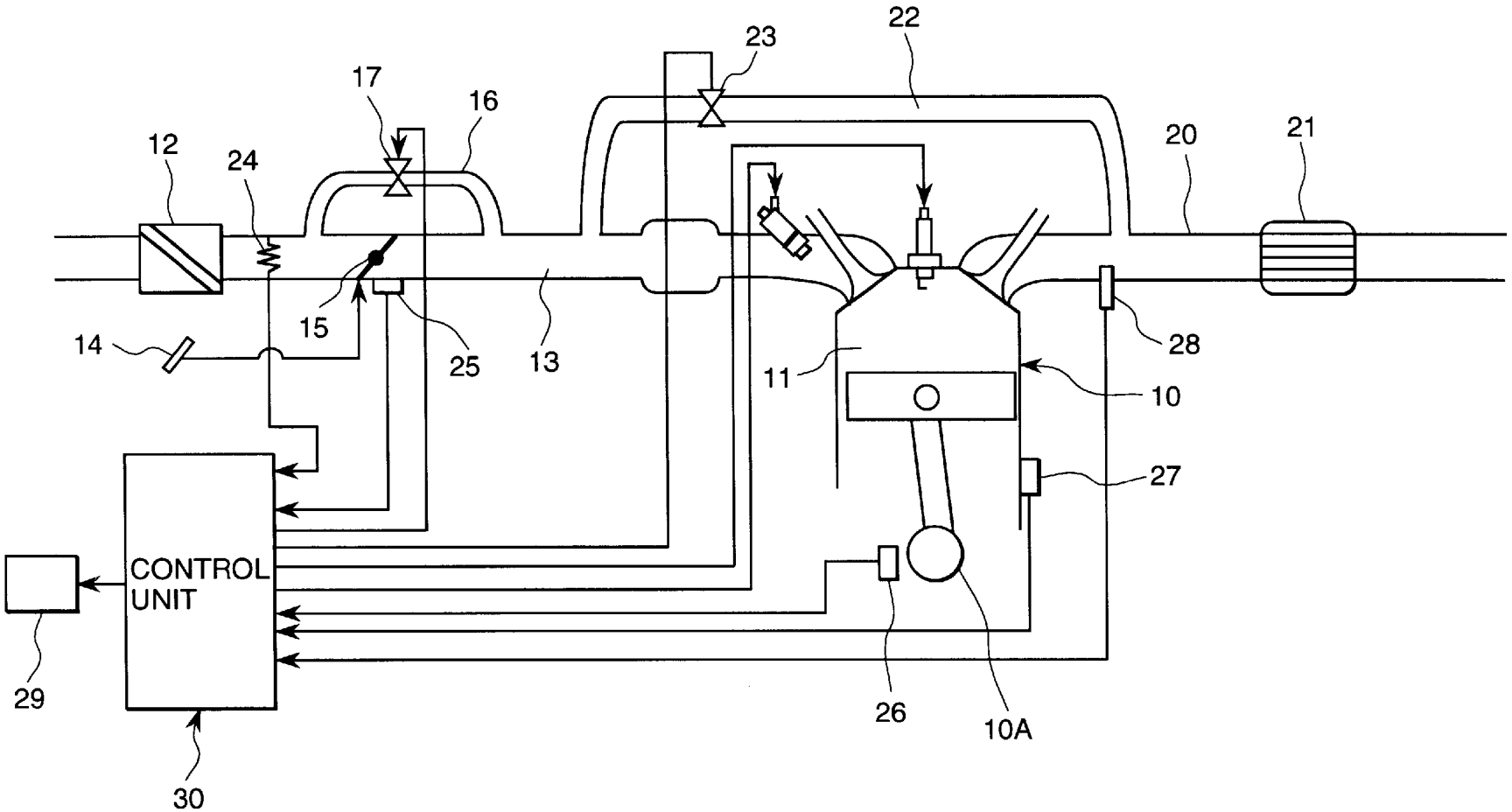
FIG. 1 is a schematic view showing the entire system of an engine to which an engine control apparatus and self-diagnosis apparatus according to the present invention are applied.

FIG. 1 shows the entire system of an engine to which an engine control apparatus and self-diagnosis apparatus according to the present invention are applied.

An engine 10 is constituted of a multiple cylinder engine, and a suction system is connected to an air cleaner 12 and suction manifold 13.

Air coming from the outside passes through the air cleaner 12 and suction manifold 13, and flows into a combustion chamber 11 of each cylinder. An in flow a ir amount is adjusted mainly by a throttle valve 15 mechanically connected to an accelerator pedal 14. During idling, an air amount is adjusted by an ISC valve 17 disposed in a bypass air passage 16 and an engine rotation number is controlled.

In the engine 10, a fuel injection valve 18 and ignition plug 19 are attached to each cylinder. Fuel injected by the fuel injection valve 18 is mixed with air from the suction manifold 13, and flows into the combustion chamber 11 to form a mixed air. The mixed air in the combustion chamber 11 is ignited by a spark generated from the ignition plug 19 at a predetermined ignition time, and combusted.

An exhaust system of the engine 10 is connected to an exhaust manifold 20 and three way catalytic converter 21. An exhaust gas of the engine 10 is fed into the three way catalytic converter 21 via the exhaust manifold 20. Respective exhaust components HC, CO, NOx in the exhaust gas are purified by the three way catalytic converter 21, and discharged to the atmosphere.

An exhaust gas re-circulation apparatus is incorporated in the engine 10, and a part of the exhaust gas is returned to a suction side through an exhaust return passage 22. A return amount of the exhaust gas is controlled by an exhaust gas return control valve 23 disposed midway in the exhaust return passage 22.

In the engine 10, sensors are disposed such as an air flow sensor 24, throttle open degree sensor 25, crank angle sensor 26, water temperature sensor 27, and linear A/F sensor 28.

The air flow sensor 24 detects an inflow air amount, the throttle open degree sensor 25 detects an open degree of the throttle valve 15, and the crank angle sensor 26 outputs a signal for each one degree of rotation angle of a crank shaft 10A of the engine 10 and a TDC signal of each cylinder. The water temperature sensor 27 detects a cooling water temperature of the engine 10.

The linear A/F sensor 28 is attached between the engine 10 and the three way catalytic converter 21, and has linear output characteristics with respect to a concentration of oxygen included in an exhaust gas. A relation between the oxygen concentration in the exhaust gas and the air/fuel ratio is substantially linear. Therefore, the air/fuel ratio can quantitatively be obtained from an output signal of the linear A/F sensor 28 for detecting the oxygen concentration of the exhaust gas.

Respective signals of the air flow sensor 24, throttle open degree sensor 25, crank angle sensor 26, water temperature sensor 27, and linear A/F sensor 28 are fed to a control unit (ECU) 30, and the control unit 30 obtains an operation state of the engine 10 from these sensor outputs to calculate a fuel basic injection amount and main operation amount of ignition time in an optimum manner.

The fuel injection amount calculated by the control unit 30 is converted to an open valve pulse signal, and the signal is fed to each cylinder fuel injection valve 18. Moreover, a drive signal is fed to the ignition plug 19 so as to ignite the fuel at the ignition time calculated by the control unit 30.

The control unit 30 calculates an upstream air/fuel ratio of the three way catalytic converter from the output signal of the linear A/F sensor 28, and performs feedback control to successively correct the basic injection amount in such a manner that the air/fuel ratio of the mixed air in the combustion chamber reaches a target air/fuel ratio.

The control unit 30 has a diagnosis function for detecting an abnormality of the linear A/F sensor 28, lights a sensor abnormality alarm lamp 29 when judging that the linear A/F sensor 28 is abnormal, and informs, for example, an operator of the sensor abnormality.

Figure 2:
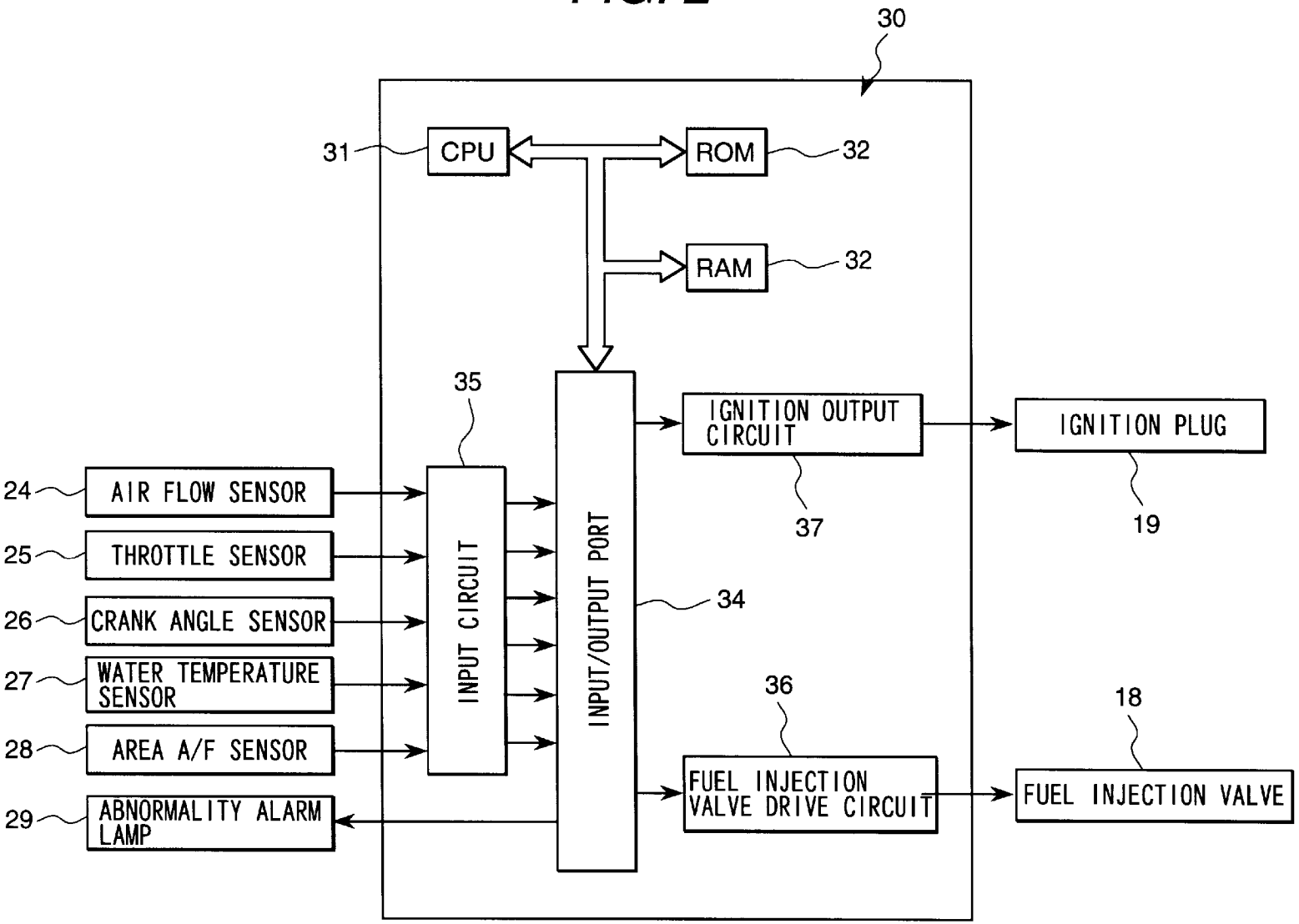
FIG. 2 is a block diagram showing an internal constitution of an engine control unit to which the engine control apparatus and self-diagnosis apparatus of the present invention are applied.

An internal constitution of the control unit 30 will next be described with reference to FIG. 2. The control unit 30 is of a type electronically controlled by a microcomputer, and includes a CPU 31, ROM 32, RAM 33, input/out put port 34, input circuit 35, fuel injection valve drive circuit 36, and ignition output circuit 37 which are connected to one another via a bus.

The control unit 30 inputs respective sensor output values of the air flow sensor 24, throttle open degree sensor 25, crank angle sensor 26, water temperature sensor 27, and linear A/F sensor 28 to the input circuit 35, performs a signal processing such as removing of a noise in the input circuit 35, and transfers the signals to the input/output port 34. Respective sensor input values are stored in the RAM 33, and calculated/processed by the CPU 31.

A control program with a calculation processing content described therein is written beforehand in the ROM 32. Values which are calculated according to the control program and indicate respective actuator operation amounts are stored in the RAM 33, and subsequently fed to the input/output port 34.

For an operation signal of the ignition plug 19 for use during spark ignition and combustion, an on/off signal is set such that the signal turns on during conduction through a primary coil in the ignition output circuit 37, and turns off during non-conduction. At the ignition time, the operation signal turns off. The ignition plug signal set in the input/output port 34 is amplified to a sufficient energy necessary for the combustion in the ignition output circuit 37 and supplied to the ignition plug 19.

For a drive signal of the fuel injection valve 18, the on/off signal is set such that the signal turns on during opening of the valve and turns off during closing of the valve. The signal is amplified to an energy sufficient for opening the fuel injection valve 18 in the fuel injection valve drive circuit 36, and supplied to the fuel injection valve 18. Additionally, the fuel injection valve 18 can independently be controlled for each cylinder.

The control program which is written in the ROM 32 of the control unit 30 and executed by the CPU 31 will next be described.

Figure 3:
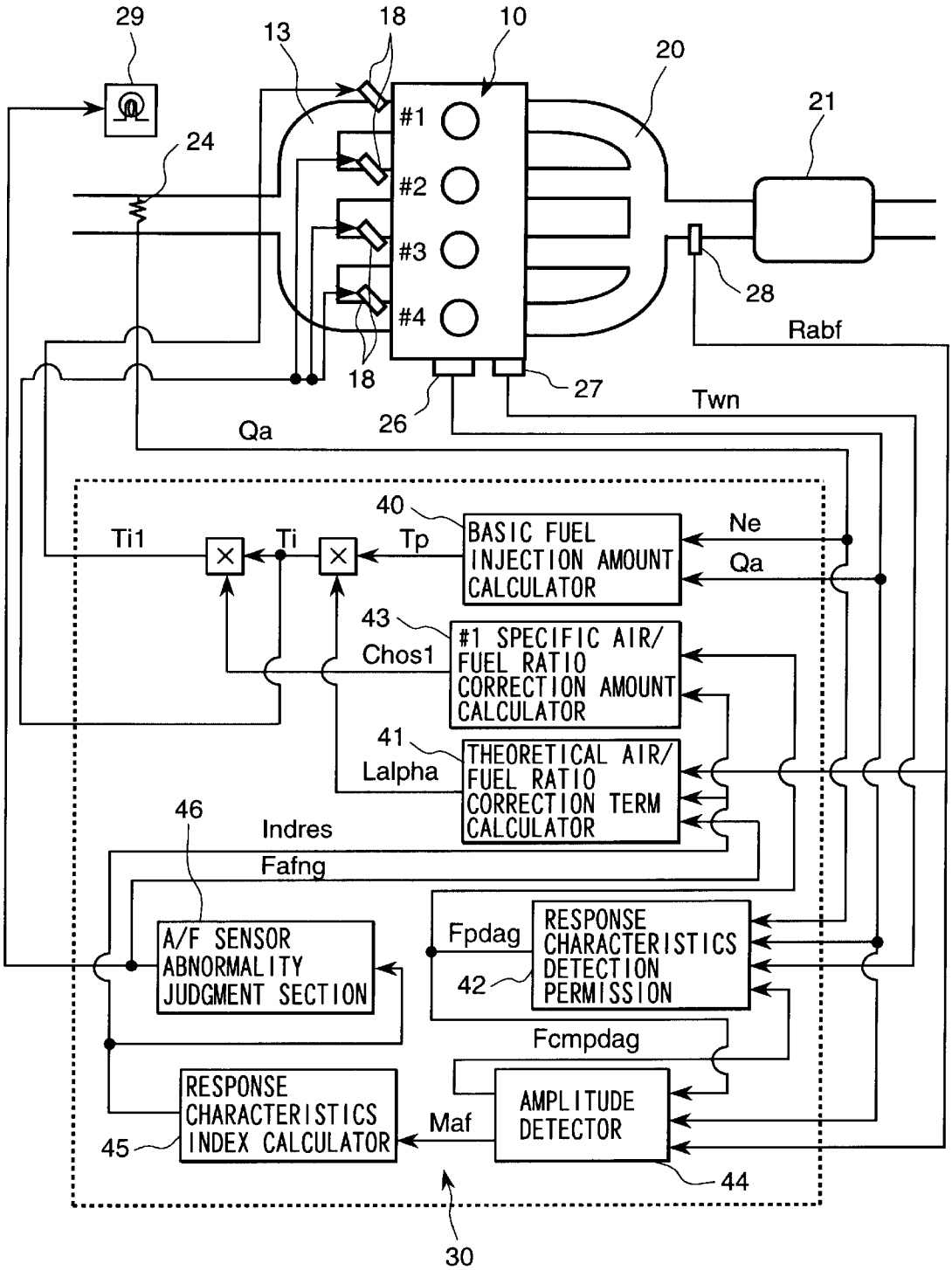
FIG. 3 is a function block diagram of a first embodiment of the engine control apparatus and self-diagnosis apparatus according to the present invention.

FIG. 3 is a function block diagram of a first embodiment of the engine control apparatus and self-diagnosis apparatus according to the present invention. When the CPU 31 executes the control program, respective control blocks of a basic fuel injection amount calculator 40, theoretical air/fuel ratio correction term calculator 41, response characteristics detection permission judgment section 42, #1 specific air/fuel ratio correction amount calculator 43, amplitude detector 44, response characteristics index calculator 45, and A/F sensor abnormality judgment section 46 are realized.

For air/fuel ratio control, during normality, that is, during non-permission of response characteristics detection, each cylinder fuel injection amount Ti is calculated in accordance with a basic fuel control operation amount Tp calculated by the basic fuel injection amount calculator 40, and a feedback control operation amount Lalpha calculated by the theoretical air/fuel ratio correction term calculator 41, so that the air/fuel ratios of all cylinders are theoretical air/fuel ratios.

On the other hand, during permission of response characteristics detection, only an equivalent amount ratio of a first cylinder #1 is increased by a predetermined amount so as to cause vibration of the air/fuel ratio in the manifold 20, and a fuel injection amount Til is obtained.

The respective control blocks will be described hereinafter in detail.

(1) Basic Fuel Injection Amount Calculator 40

The basic fuel injection amount calculator 40 calculates a fuel injection amount (basic fuel injection amount) for simultaneously realizing a target torque and target air/fuel ratio in arbitrary operation conditions based on the air inflow amount and rotation number of the engine 10.

Figure 4:
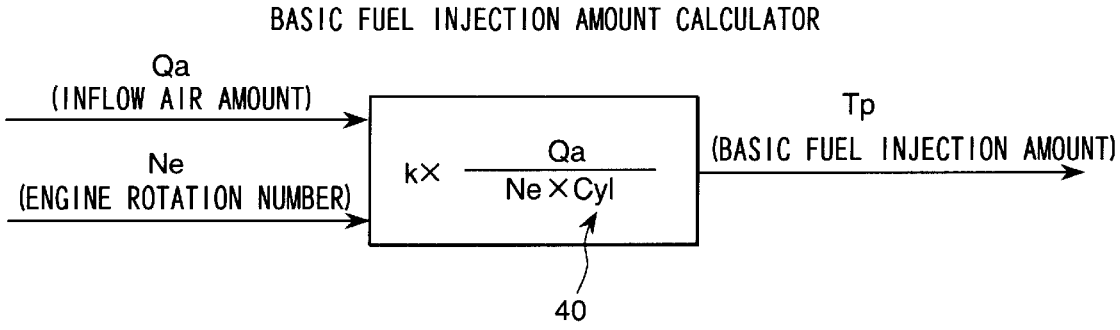
FIG. 4 is a block diagram of a basic fuel injection amount calculator in the engine control apparatus and self-diagnosis apparatus according to the present invention.

Concretely, as shown in FIG. 4, the basic fuel injection amount $Tp=K(Qa/Ne\cdot Cyl)$ is calculated. Here, K is a constant, and indicates a value by which the injection amount is constantly adjusted so as to realize a theoretical air/fuel ratio with respect to an inflow air amount Qa. Moreover, Ne denotes the engine rotation number, and Cyl denotes the number of cylinders of the engine 10.

(2) Theoretical Air/Fuel Ratio Correction Term Calculator 41

The theoretical air/fuel ratio correction term calculator 41 performs feedback control so as to set the air/fuel ratio of the engine 10 to the theoretical air/fuel ratio in the arbitrary operation conditions based on the air/fuel ratio detected by the linear A/F sensor 28.

Figure 5:
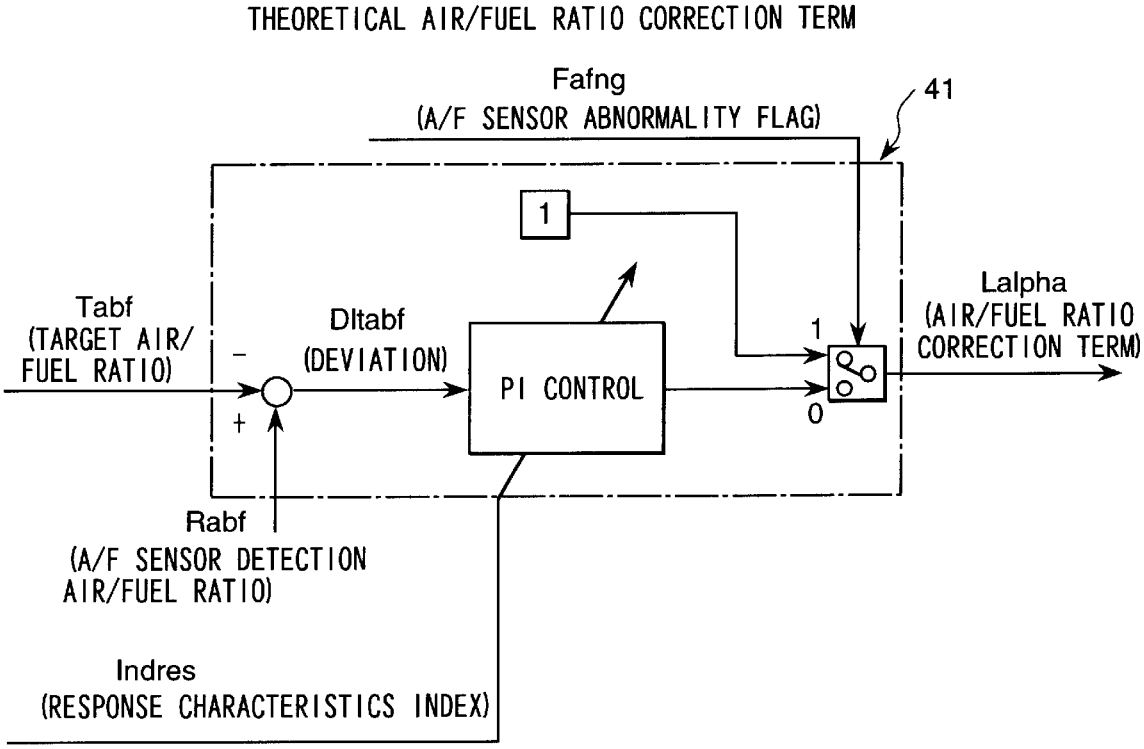
FIG. 5 is a block diagram of a theoretical air/fuel ratio correction term calculator in the engine control apparatus and self-diagnosis apparatus according to the present invention.
Figure 11:
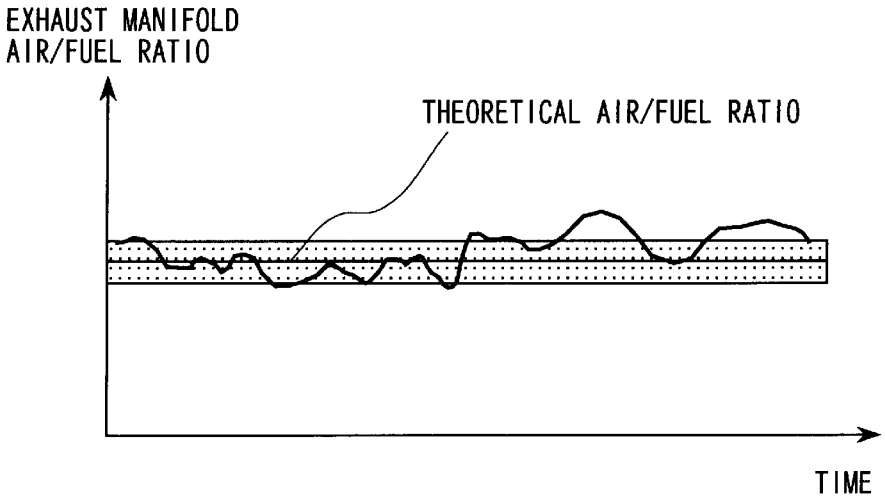
FIG. 11 is a waveform diagram of an a ir/fuel ratio of an exhaust manifold when the air/fuel ratio of each cylinder is uniform.

Concretely, as shown in FIG. 5, an air/fuel ratio correction term Lalpha is calculated from a deviation Dltabf of a target air/fuel ratio (theoretical air/fuel ratio) Tabf and A/F sensor detected air/fuel ratio Rabf by proportional/integration (PI) control. The air/fuel ratio correction term Lalpha is multiplied by the basic fuel injection amount Tp, so that the air/fuel ratio of the engine 10 is set to the theoretical air/fuel ratio. In this case, the air/fuel ratio in the exhaust manifold 20 is substantially the theoretical air/fuel ratio as shown in FIG. 11.

Additionally, when the linear A/F sensor 28 is abnormal, that is, when an A/F sensor abnormality flag described later is Fafng=0, Lalpha=1, and the feedback control by the A/F sensor detected air/fuel ratio Rabf is not performed.

Moreover, respective gains of the PI control are set to be variable in accordance with a response characteristics index Indres indicating the response characteristics of the engine 10.

(3) Response Characteristics Detection Permission Judgment Section 42

The response characteristics detection permission judgment section 42 judges whether detection of the response characteristics is permitted.

Figure 6:
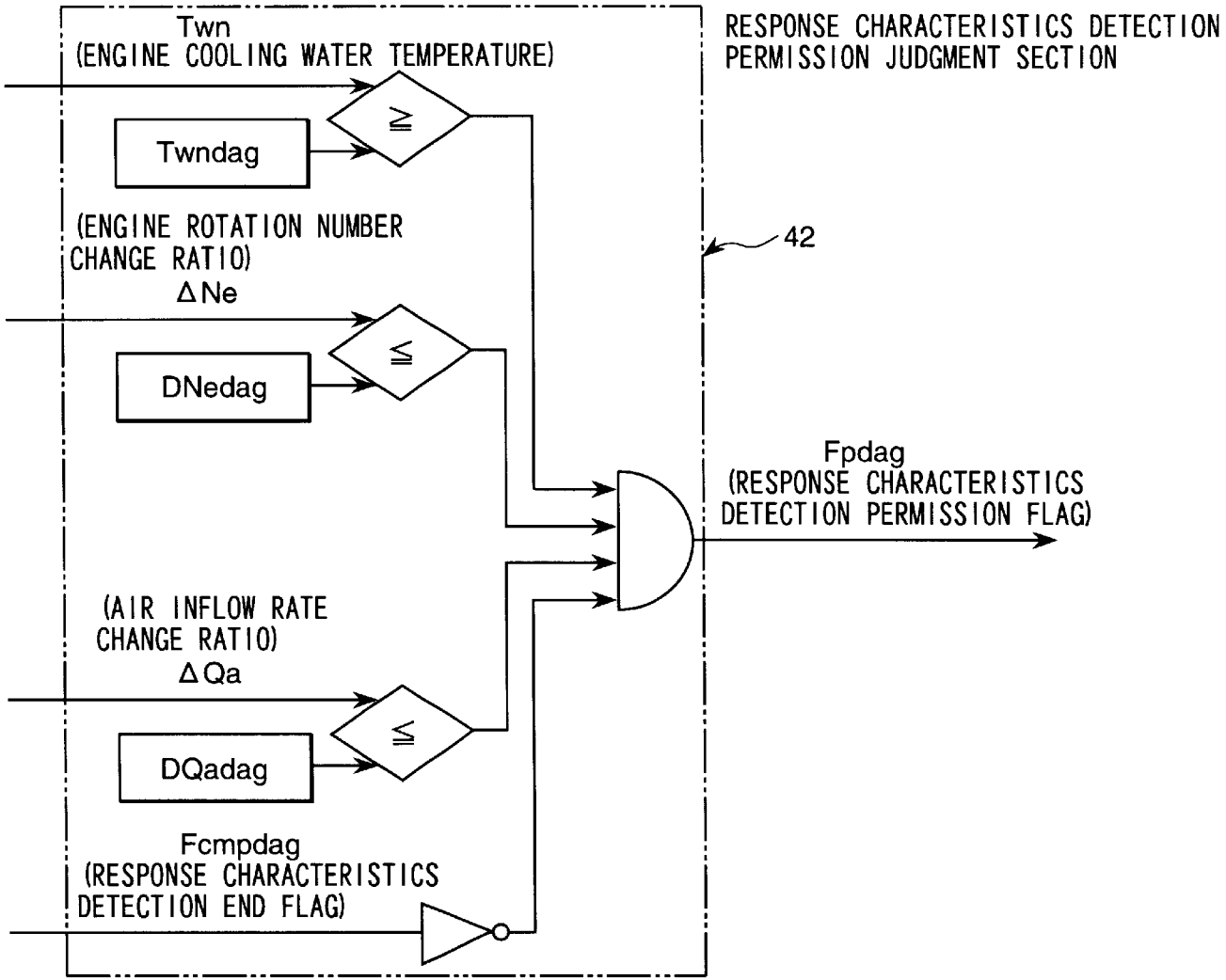
FIG. 6 is a block diagram of a response characteristics detection permission judgment section in the engine control apparatus and self-diagnosis apparatus according to the present invention.

Concretely, as shown in FIG. 6, when an engine cooling water temperature is $Twn \geqq Twndag$, engine rotation number change ratio is $\Delta Ne \leqq DNedag$, an air inflow amount change ratio is $\Delta Qa \leqq Dqadag$, and a response characteristics detection end flag is Fcmpdag=0, a response characteristics detection permission flag is set to Fpdag=1, and the detection of the response characteristics is permitted. In other cases, the detection of the response characteristics is prohibited, and Fpdag=0.

For a defined value DNedag of the engine rotation number change ratio $\Delta Ne$, and defined value Dqadag of the air inflow amount change ratio $\Delta Qa$, parameters are preset.

Additionally, for the engine rotation number change ratio $\Delta Ne$, or the air inflow amount change ratio $\Delta Qa$, a difference between a value calculated in the previous job and a value calculated in the present job may be set.

(4) #1 Specific Air/Fuel Ratio Correction Amount Calculator 43

The #1 specific air/fuel ratio correction amount calculator 43 regards the first cylinder #1 as the specific cylinder of the engine 10, and calculates the air/fuel ratio correction amount of the first cylinder #1.

During normality, that is, when the response characteristics detection permission flag is Fpdag=0, the respective cylinder fuel injection amounts are calculated in accordance with the basic fuel injection amount Tp and air/fuel ratio correction term Lalpha so that the air/fuel ratios of all cylinders are the theoretical air/fuel ratios. However, when the response characteristics detection permission flag is Fpdag=1, only the equivalent amount ratio of the first cylinder #1 is increased by a predetermined amount Kchos1 so as to cause the vibration of the air/fuel ratio in the exhaust manifold 20. Thereby, only the air/fuel ratio of the first cylinder #1 is a rich air/fuel ratio.

Figure 12:
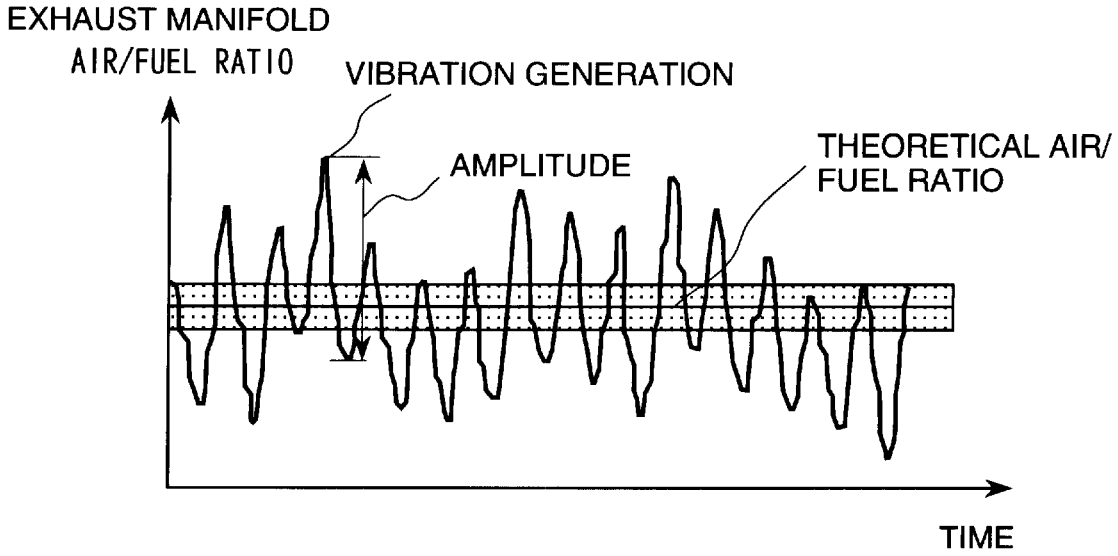
FIG. 12 is a waveform diagram of the air/fuel ratio of the exhaust manifold when the air/fuel ratio of each cylinder is non-uniform.
Figure 13:
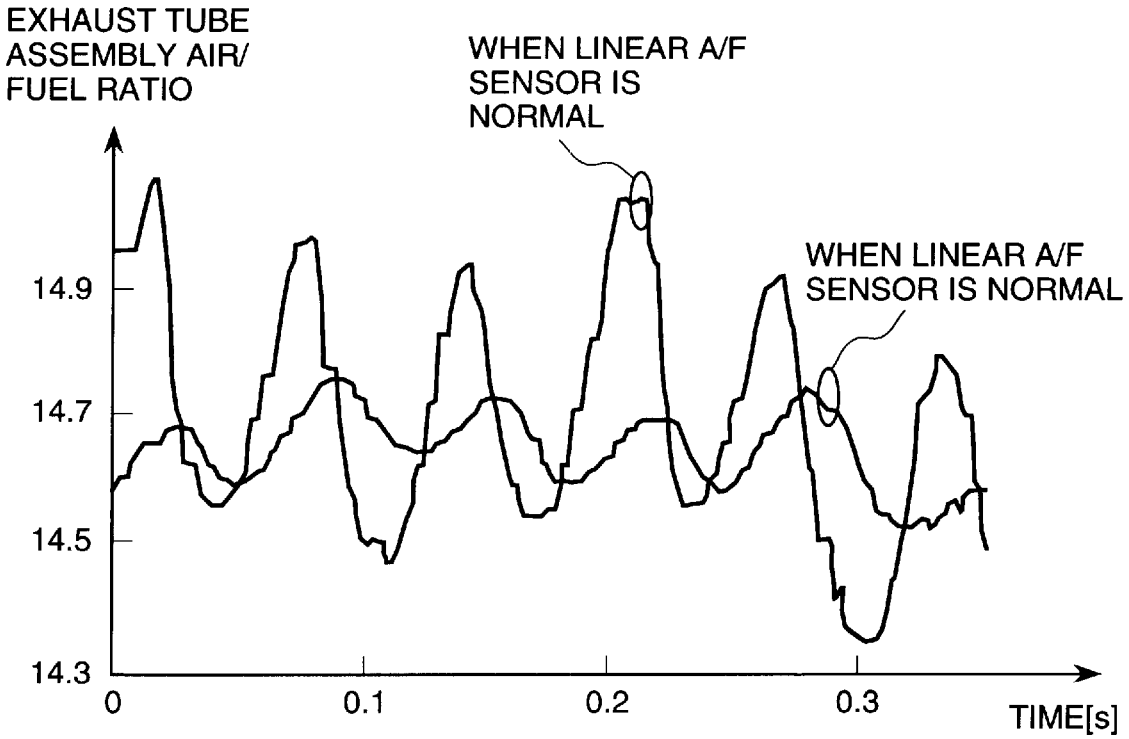
FIG. 13 is a waveform diagram of the air/fuel ratio of the exhaust manifold when linear A/F sensor response characteristics are normal and abnormal.

In this case, as shown in FIG. 12, the air/fuel ratio in the exhaust manifold 20 relatively largely fluctuates periodically. As shown in FIG. 13, the amplitude of the vibration of the air/fuel ratio indicates a relatively large value when the linear A/F sensor 28 is normal. When the sensor is deteriorated, the amplitude decreases.

Figure 7:
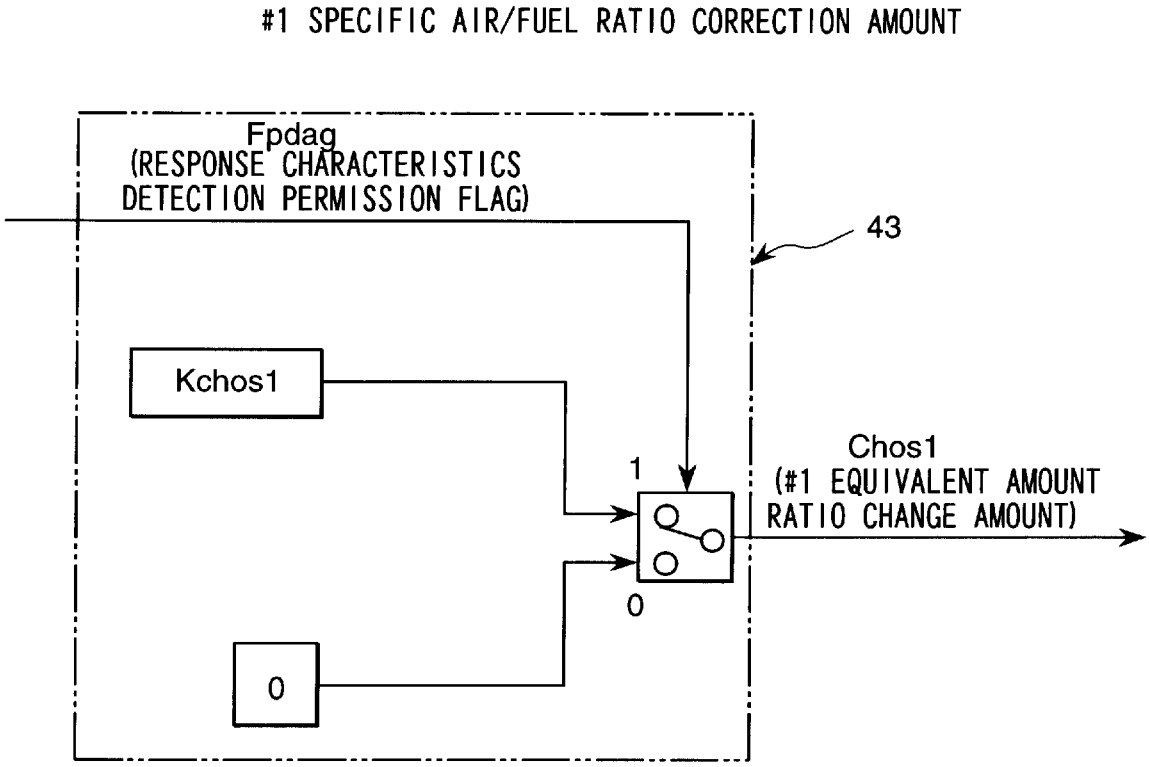
FIG. 7 is a block diagram of a #1 specific air/fuel ratio correction amount calculator in the engine control apparatus and self-diagnosis apparatus according to the present invention.

Concretely, as shown in FIG. 7, when Fpdag=1, the equivalent amount ratio change amount of the first cylinder is Chos1. In this case, as shown in FIG. 12, the air/fuel ratio in the exhaust manifold 20 relatively largely fluctuates periodically.

Concretely, as shown in FIG. 7, when Fpdag=1, the equivalent amount ratio change amount of the first cylinder is Chos1=Kchos1. When Fpdag=0, Chos1=0. Additionally, the value of the first cylinder equivalent amount ratio change amount=Kchos1 is preferably set in accordance with the characteristics of the engine 10 and three way catalytic converter 21, so that exhaust performance is not deteriorated.

(5) Amplitude Detector 44

The amplitude detector 44 detects the amplitude (periodic fluctuation amount) of the A/F sensor detected air/fuel ratio in a state in which the #1 specific air/fuel ratio correction amount calculator 43 increases the air/fuel ratio of the first cylinder #1 by the predetermined amount Kchos1 as described above.

Figure 8:
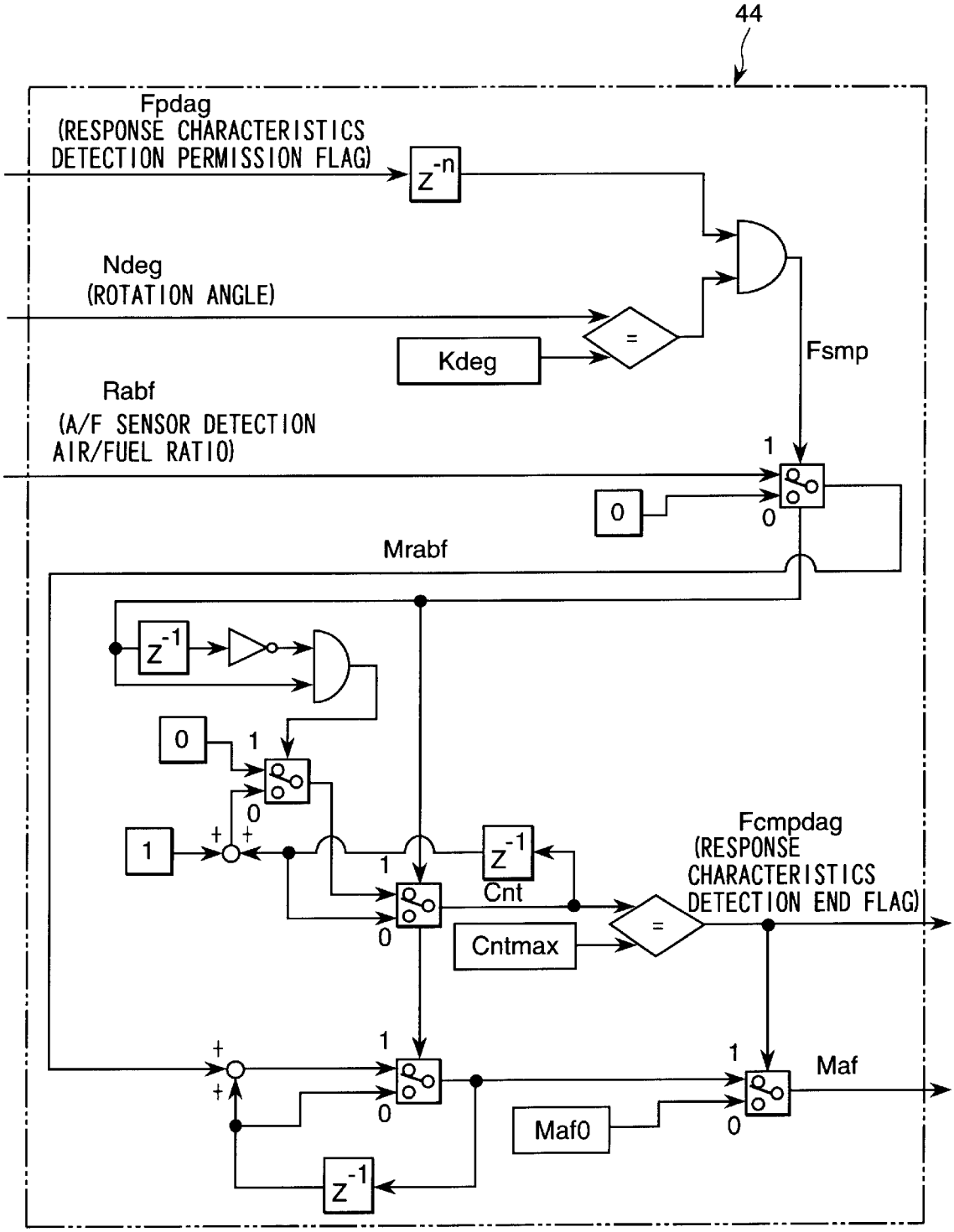
FIG. 8 is a block diagram of an amplitude detector in the engine control apparatus and self-diagnosis apparatus according to the present invention.

Concretely, as shown in FIG. 8, when a value of the response characteristics detection permission flag Fpdag obtained n-times before is 1, and a rotation angle Ndeg is a predetermined angle Kdeg, a sampling permission flag is set to Fsmp=1, the value of the A/F sensor detected air/fuel ratio Rabf is sampled, and an air/fuel ratio sampling value Mrabf is obtained.

The value of the response characteristics detection permission flag Fpdag obtained n-times before is used for the following reason. That is, there is a delay by the engine 10 from when the flag is set to Fpdag=1 until the vibration (fluctuation) actually appears in the air/fuel ratio of the exhaust manifold 20. Moreover, a vibration cycle of the air/fuel ratio generated by setting the air/fuel ratio of the first cylinder #1 to be rich depends on the engine rotation number. Therefore, the A/F sensor detected air/fuel ratio Rabf is sampled with the predetermined angle Kdeg. The rotation angle Ndeg is obtained from the signal of each one degree of the crank rotation angle outputted from the crank angle sensor 26 and the TDC signal of each cylinder.

When the sampling permission flag is Fsmp=1, an integrated value of the air/fuel ratio sampling value Mrabf is calculated, and a calculation times number Cnt is incremented by one. Additionally, an initial value of the calculation times number Cnt is set to zero.

When Cnt=Cntmax, the response characteristics detection end flag is set to Fcmpdag=1, calculation of the integrated value is stopped, and the integrated value is outputted asan amplitude Maf. Calculation times set value Cntmax may by set as a value to be realized by consideraing an actual operation state (6) Response Characteristics Index Calculator 45

The response chacteristics index calculator 45 calculates the response characteristics index from the amplitude of the A/F sensor detected air/fuel ratio for the variable gain control of the PI control in the theoretical air/fuel ratio correction term calculator 41.

Figure 9:
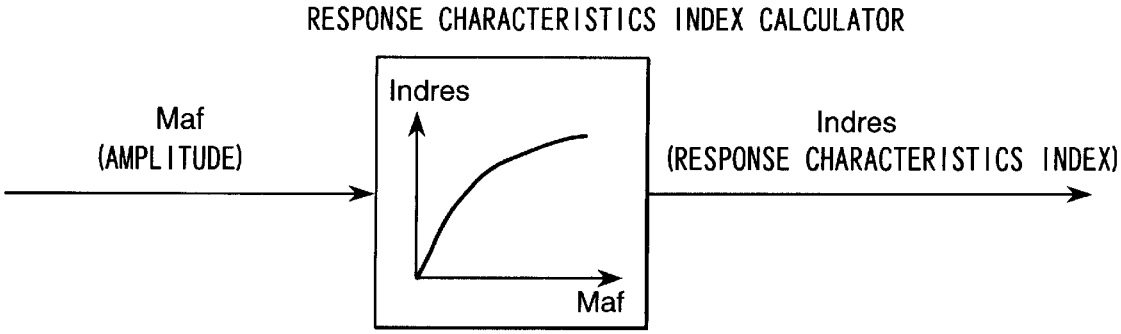
FIG. 9 is a block diagram of a response characteristics index calculator in the engine control apparatus and self-diagnosis apparatus according to the present invention.

Correctly, as shown in FIG. 9, the amplitude Maf is converted with a conversion table, and the response characteristics index Indres is obtained. The response characteristics index Indres corresponds, for example, to a time constant, and is a representative parameter indicating transmission characteristics.

In this case, in the conversion table showing a correlation between the amplitude Maf and the response characteristics index Indres, a relation between the amplitude Maf and the time constant is shown. When a PI control feedback gain is determined, the parameter indicating the transmission characteristics, such as the response characteristics index Indres, is more easily treated. Therefore, such conversion is performed in the PI control.

(7) A/F Sensor Abnormality Judgment Section 46

The A/F sensor abnormality judgment section 46 judges whether there is an abnormality in the A/F sensor response characteristics.

Figure 10:
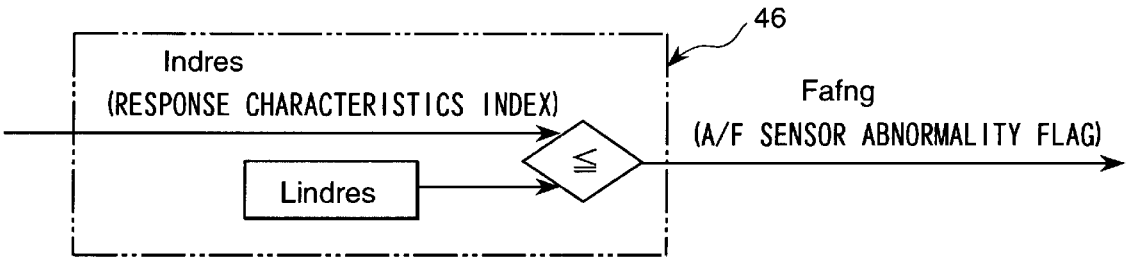
FIG. 10 is a block diagram of an A/F sensor abnormality judgment section in the engine control apparatus and self-diagnosis apparatus according to the present invention.

Concretely, as shown in FIG. 10, when the response characteristics of the linear A/F sensor 28 are deteriorated, the response characteristics index Indres decreases.

Therefore, when the response characteristics index Indres is smaller than a predetermined value (sensor abnormality judgment value) Lindres, it is judged that the A/F sensor response characteristics are abnormal.

That is, when the response characteristics index is Indres≦Lindres, it is judged that the response characteristics are abnormal, and the A/F sensor abnormality flag is set to Fafng=1. In other cases, it is judged that the linear A/F sensor 28 is normal, and Fafng=0 is set.

When the A/F sensor abnormality flag is Fafng=1, as described above, the air/fuel ratio feedback control by the linear A/F sensor 28 is stopped. Moreover, when the A/F sensor abnormality flag is Fafng=1, the sensor abnormality alarm lamp 29 is lit and, for example, the operator may be informed of the abnormality.

Additionally, for the sensor abnormality judgment value Lindres by the response characteristics index Indres, an adequate value of parameter can be set from the response characteristics of the linear A/F sensor 28 and feedback control characteristics.

In the aforementioned processing, while the crank shaft 10A of the engine 10 rotates at least twice, the amplitude of the air/fuel ratio is obtained. Therefore, the response characteristics of the linear A/F sensor 28 as the air/fuel ratio detection means can be diagnosed in a short time, and the diagnosis can be performed in broad operation conditions. Diagnosis opportunities increase, and high-precision diagnosis is possible without being easily influenced by disturbances.

Second Embodiment

Figure 14:
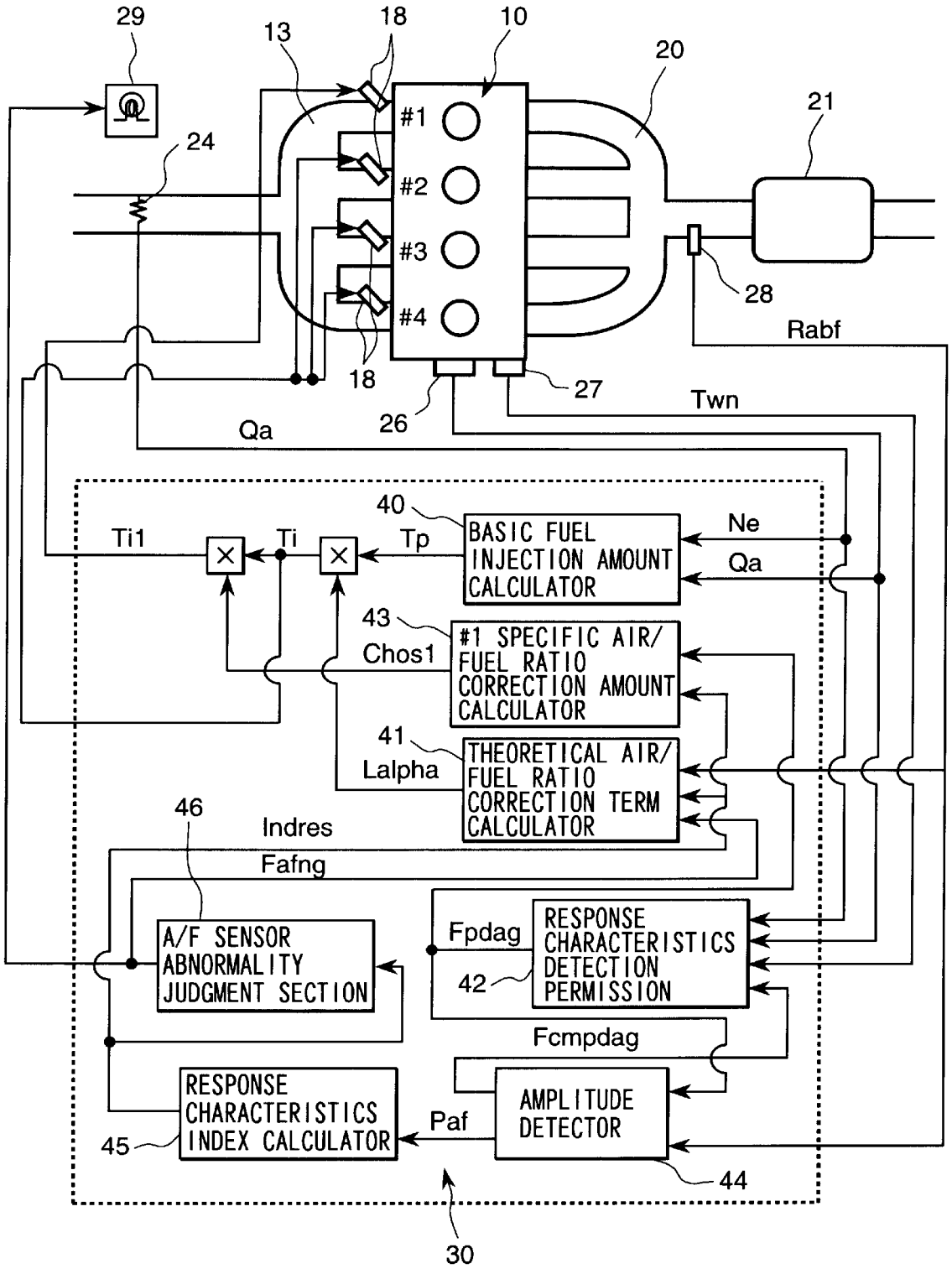
FIG. 14 is a function block diagram of a second embodiment of the engine control apparatus and self-diagnosis apparatus according to the present invention.

FIG. 14 is a function block diagram of a second embodiment of the engine control apparatus and self-diagnosis apparatus according to the present invention. Additionally, in FIG. 14, components corresponding to those of FIG. 3 are denoted with the same reference numerals as those of FIG. 3, and description thereof is omitted. Additionally, a system constitution is the same as that of the first embodiment shown in FIGS. 1 and 2.

When the CPU 31 executes the control program, the respective control blocks of the basic fuel injection amount calculator 40, theoretical air/fuel ratio correction term calculator 41, response characteristics detection permission judgment section 42, #1 specific air/fuel ratio correction amount calculator 43, power detector 47, response characteristics index calculator 45', and A/F sensor abnormality judgment section 46 are realized.

For air/fuel ratio control, similarly as the first embodiment, during normality, that is, during non-permission of response characteristics detection, each cylinder fuel injection amount Ti is calculated in accordance with the basic fuel control operation amount Tp calculated by the basic fuel injection amount calculator 40, and the feedback control operation amount Lalpha calculated by the theoretical air/fuel ratio correction term calculator 41, so that the air/fuel ratios of all cylinders are the theoretical air/fuel ratios.

On the other hand, during permission of response characteristics detection, only the equivalent amount ratio of the first cylinder #1 is increased by the predetermined amount so as to cause the vibration of the air/fuel ratio in the manifold 20, and the fuel injection amount Til is obtained.

The respective control blocks will be described hereinafter in detail.

Since the basic fuel injection amount calculator 40, theoretical air/fuel ratio correction term calculator 41, response characteristics detection permission judgment section 42, #1 specific air/fuel ratio correction amount calculator 43, and A/F sensor abnormality judgment section 46 are the same as those of the first embodiment, the description thereof is omitted to avoid redundancy.

(5') Power Detector 47

The power detector 47 detects a power of a predetermined frequency of the A/F sensor detected air/fuel ratio Rabf.

Figure 15:
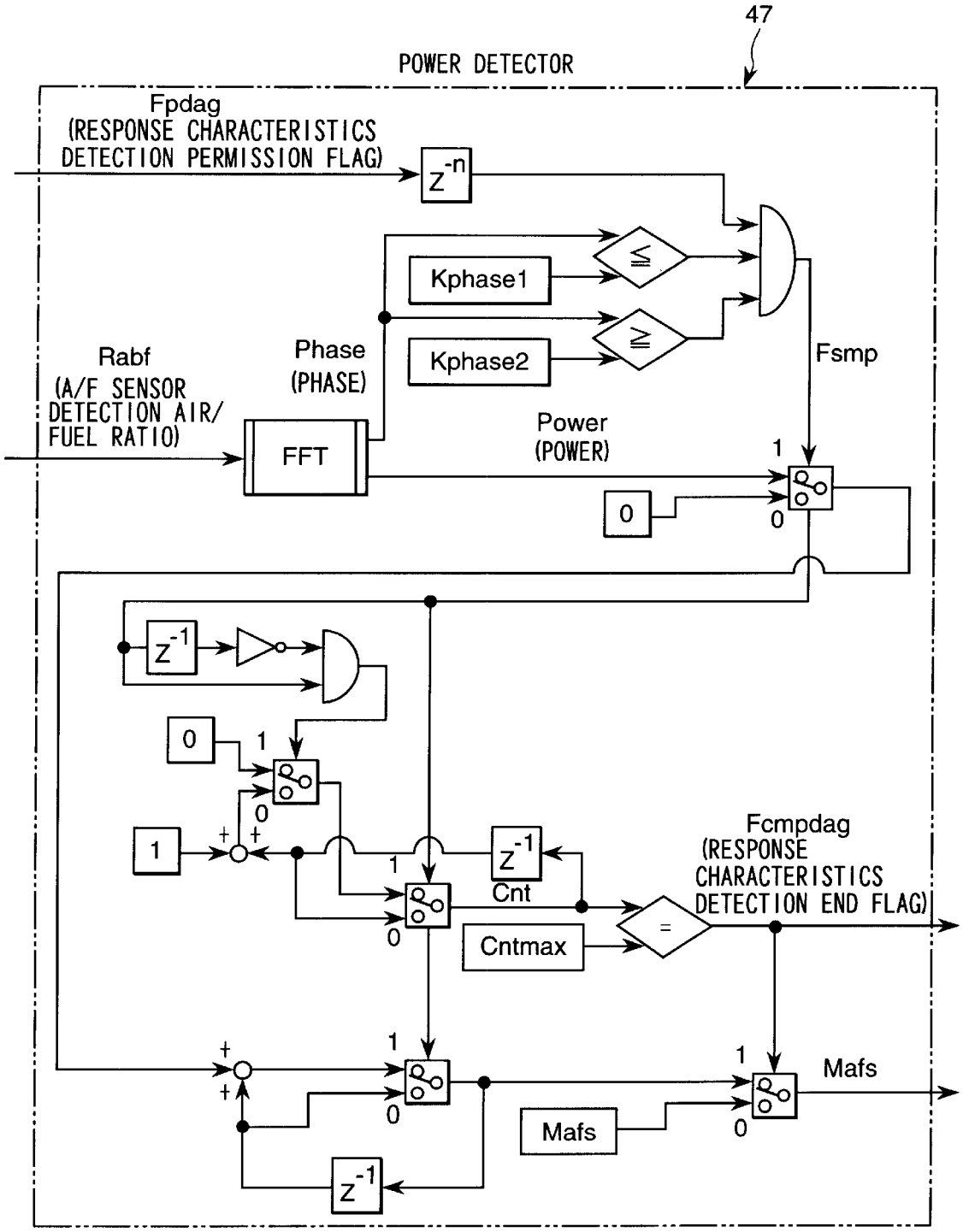
FIG. 15 is a block diagram of a power detector in the engine control apparatus and self-diagnosis apparatus according to the present invention.

Concretely, as shown in FIG. 15, the A/F sensor detected air/fuel ratio Rabf is sampled, and a predetermined frequency power Power and phase Phase are calculated by FET.

A sampling cycle is synchronous with rotation, and is preferably Cy1/2 while the engine 10 rotates at least once. Here, Cy1 denotes the number of cylinders. Moreover, the predetermined frequency is preferably fe/2. Here, fe denotes a frequency corresponding to the engine rotation number.

When the value of the response characteristics detection permission flag Fpdag obtained n-times before is 1, and the phase is in a predetermined range, that is, Kphase1≦Phase≦Kphase2, the sampling permission flag is set to Fsmp=1. The value of the response characteristics detection permission flag Fpdag obtained n-times before is used for the following reason. That is, there is a delay by the engine 10 from when the flag is set to Fpdag=1 until the vibration actually appears in the air/fuel ratio of the exhaust manifold 20.

Moreover, the vibration cycle of the air/fuel ratio generated by setting the air/fuel ratio of the first cylinder #1 to be rich depends on the engine rotation number. Therefore, only when the phase appears in a predetermined phase range of Kphase1 to Kphase2, the power is generated by setting the first cylinder to be rich. The phases Kphase1 and Kphase2 are set in accordance with the engine transmission characteristics. When the sampling permission flag is Fsmp=1, an integrated value Paf of Power is calculated, and the calculation times number Cnt is incremented by one. Additionally, the initial value of the calculation times number Cnt is zero.

When Cnt=Cntmax, the response characteristics detection end flag is set to Fcmpdag=1, the calculation of the integrated value is stopped, and the integrated value is outputted as Mafs. This value is a change amount of the A/F sensor detected air/fuel ratio in a specific phase. The value Cntmax may be set as the value which can be realized by considering the actual operation state.

Figure 16:
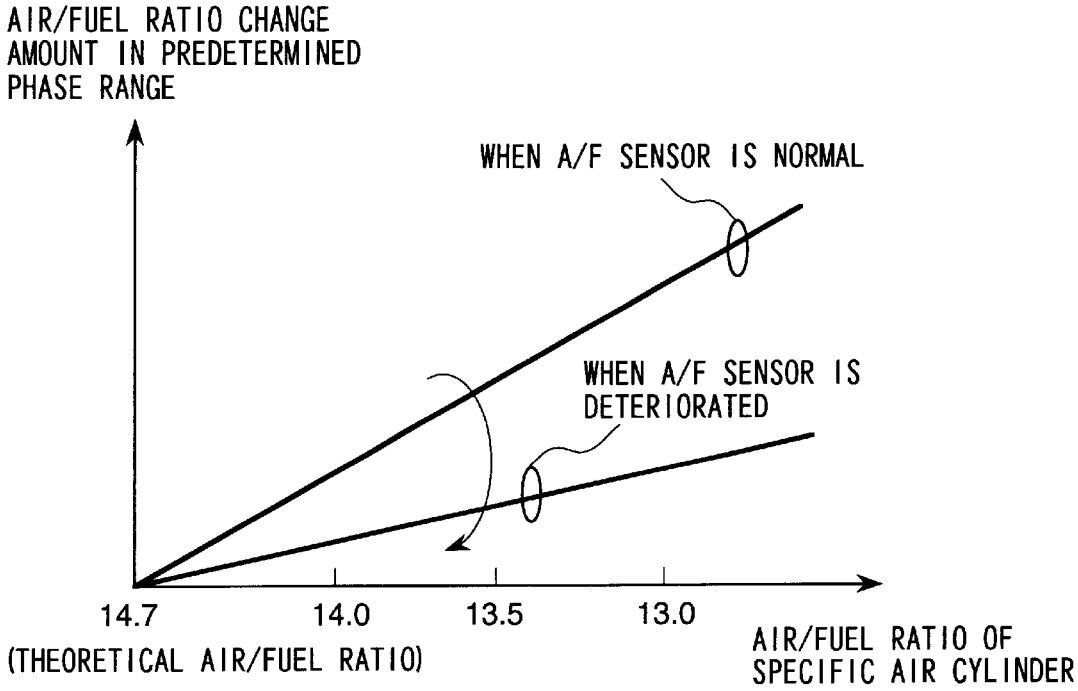
FIG. 16 is a graph showing a relation between an air/fuel ratio applied to a specific cylinder and an air/fuel ratio change amount in a predetermined phase range.

As shown in FIG. 13, when the linear A/F sensor 28 is normal, the amplitude of the vibration of the air/fuel ratio indicates a relatively large value. The amplitude decreases when the sensor is deteriorated. Therefore, as shown in FIG. 16, when the linear A/F sensor 28 is normal, the change amount Mafs of the A/F sensor detected air/fuel ratio in the specific phase also indicates a relatively large value. The amount decreases when the sensor is deteriorated.

(6') Response Characteristics Index Calculator 45'

The response characteristics index calculator 45' calculates the response characteristics index from the change amount of the A/F sensor detected air/fuel ratio in the specific phase for the variable gain control of the PI control in the theoretical air/fuel ratio correction term calculator 41.

Figure 17:
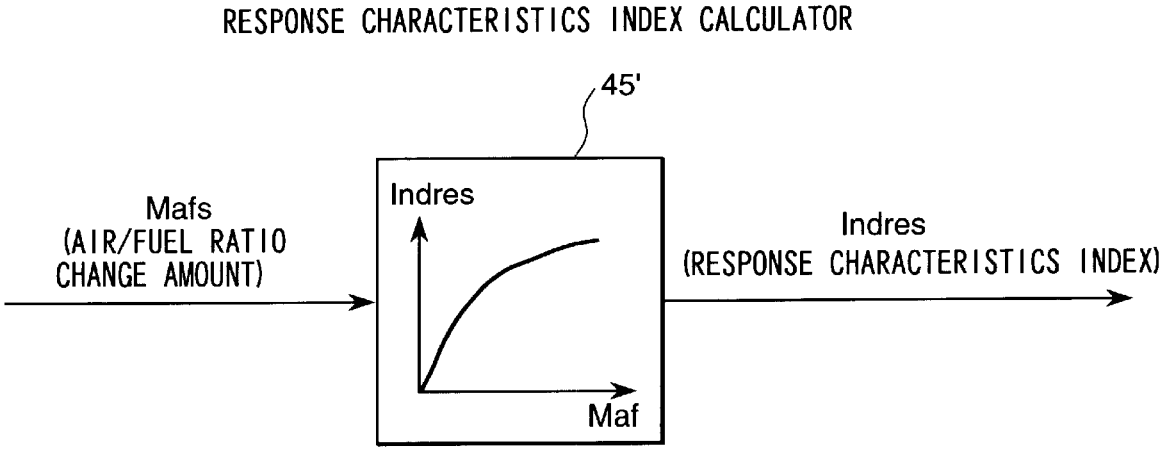
FIG. 17 is a block diagram of the response characteristics index calculator in the engine control apparatus and self-diagnosis apparatus according to the present invention.

Correctly, as shown in FIG. 17, the change amount Mafs of the A/F sensor detected air/fuel ratio in the specific phase is converted with the conversion table, and the response characteristics index Indres is obtained. The response characteristics index Indres corresponds, for example, to the time constant, and is a representative parameter indicating the transmission characteristics.

In this case, in the conversion table showing a correlation between the air/fuel ratio change amount Mafs and the response characteristics index Indres, a relation between the air/fuel ratio change amount Mafs and the time constant is shown. Also in this case, when the PI control feedback gain is determined, the parameter indicating the transmission characteristics, such as the response characteristics index Indres, is more easily treated. Therefore, such conversion is performed in the PI control.

Therefore, also in this embodiment, while the crank shaft 10A of the engine 10 rotates at least twice, the change of the A/F sensor detected air/fuel ratio in the specific phase can be obtained. Therefore, the response characteristics of the linear A/F sensor 28 as the air/fuel ratio detection means can be diagnosed in a short time. Moreover, the diagnosis can be performed in the broad operation conditions. Therefore, the diagnosis opportunities increase, and high-precision diagnosis can be performed without being easily influenced by disturbances.

Additionally, in the first and second embodiments, when the engine cooling water temperature Twn indicates the predetermined value Twndag, the response characteristics are detected. However, when the engine cools down, that is, even when the engine cooling water temperature Twn is low, the detection is possible with the activated linear A/F sensor 28. Additionally, the response characteristics are detected when the engine cools down and warms up. If there is a difference between both results, the result of a point at which the engine cools down can be used in judging a fuel property.

Other Embodiments

Figure 18:
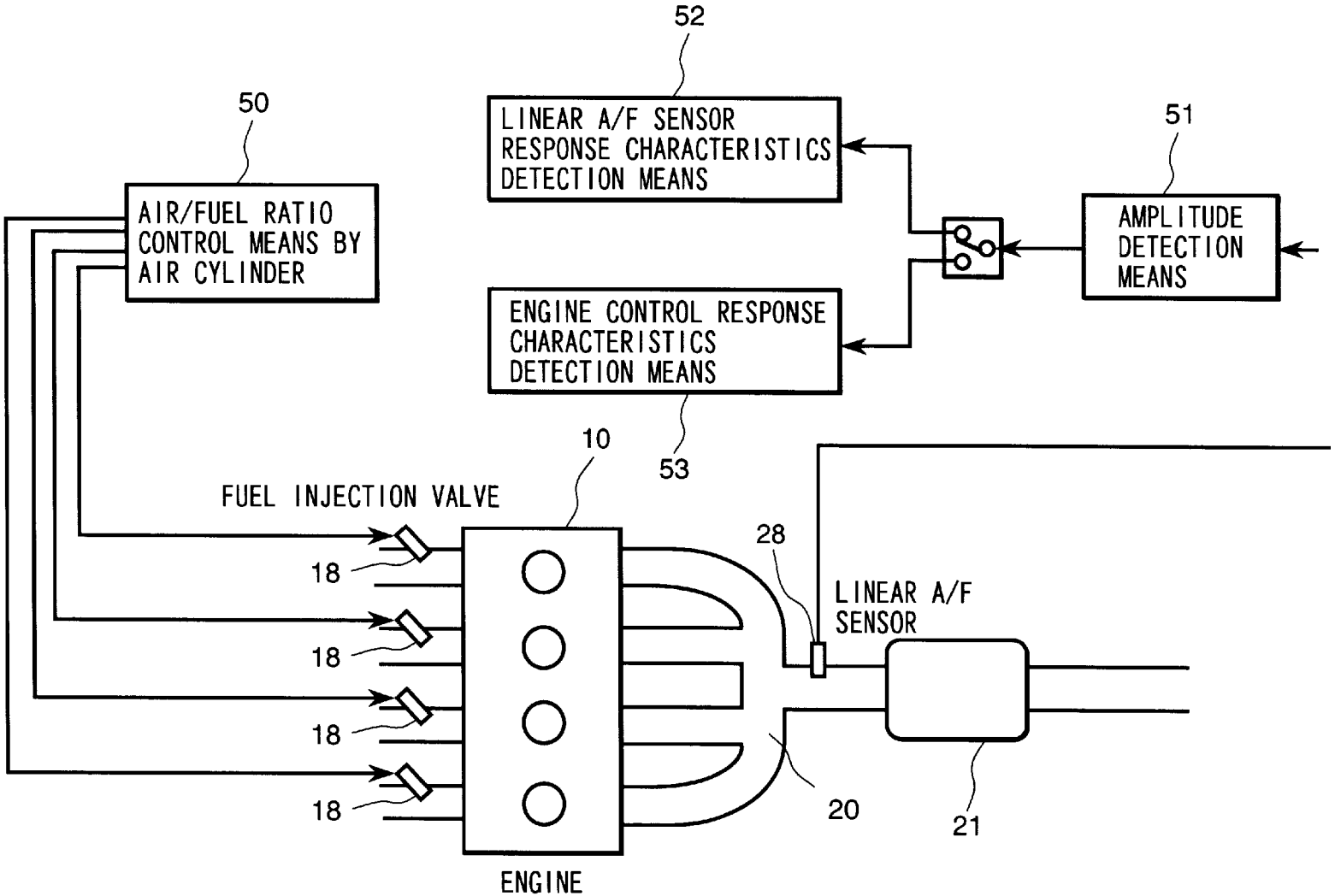
FIG. 18 is a schematic view showing another embodiment of the engine control apparatus and self-diagnosis apparatus according to the present invention.
Figure 19:
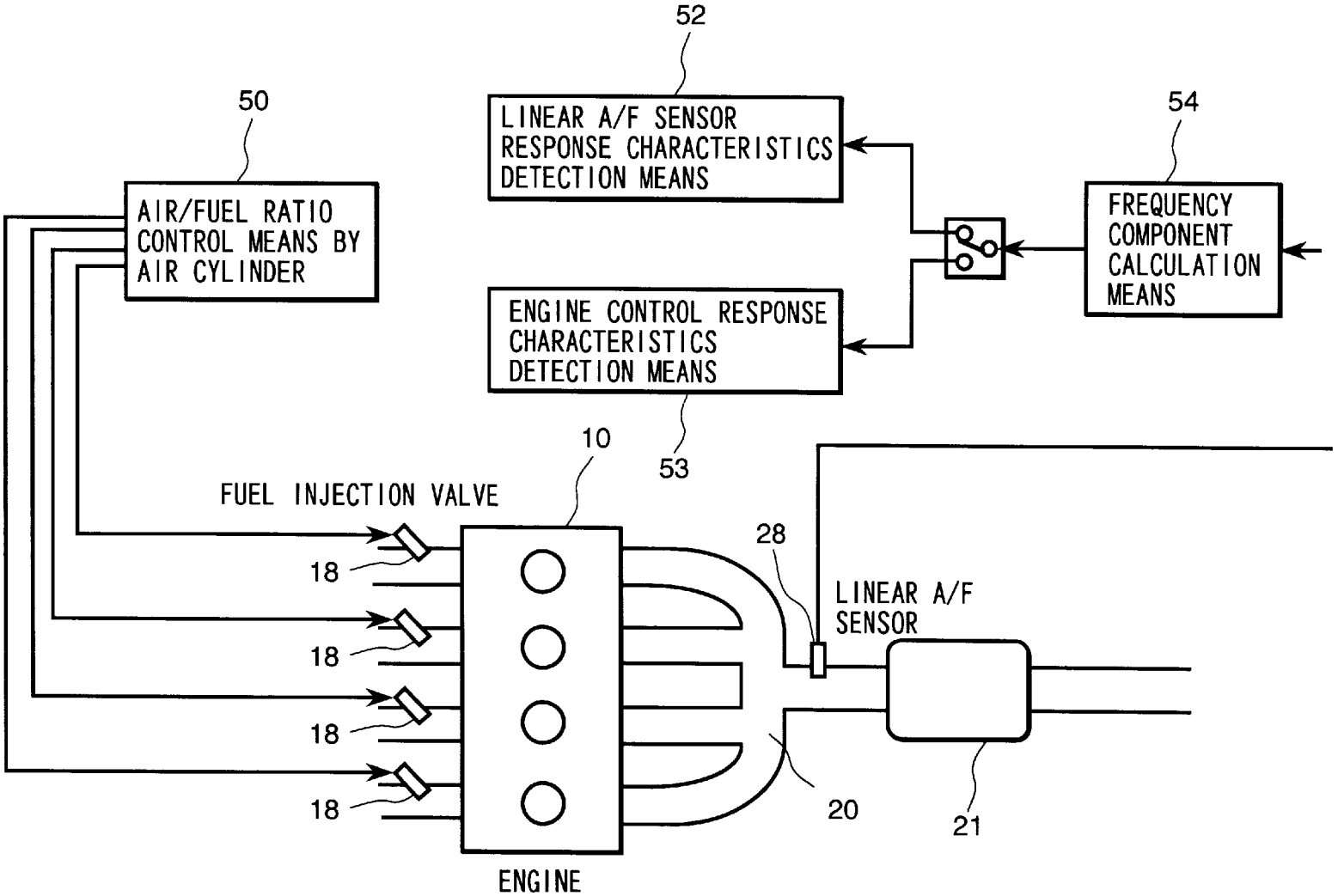
FIG. 19 is a schematic view showing another embodiment of the engine control apparatus and self-diagnosis apparatus according to the present invention.
Figure 20:
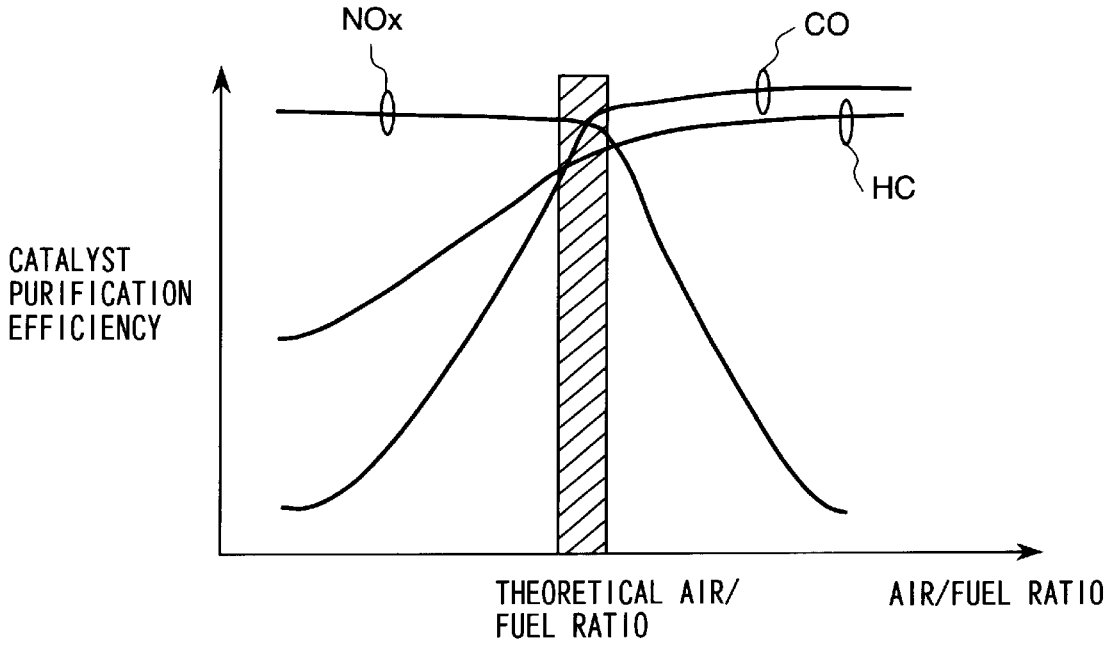
FIG. 20 is a graph showing a purification efficiency of a three way catalytic converter with respect to the air/fuel ratio.
Figure 21:
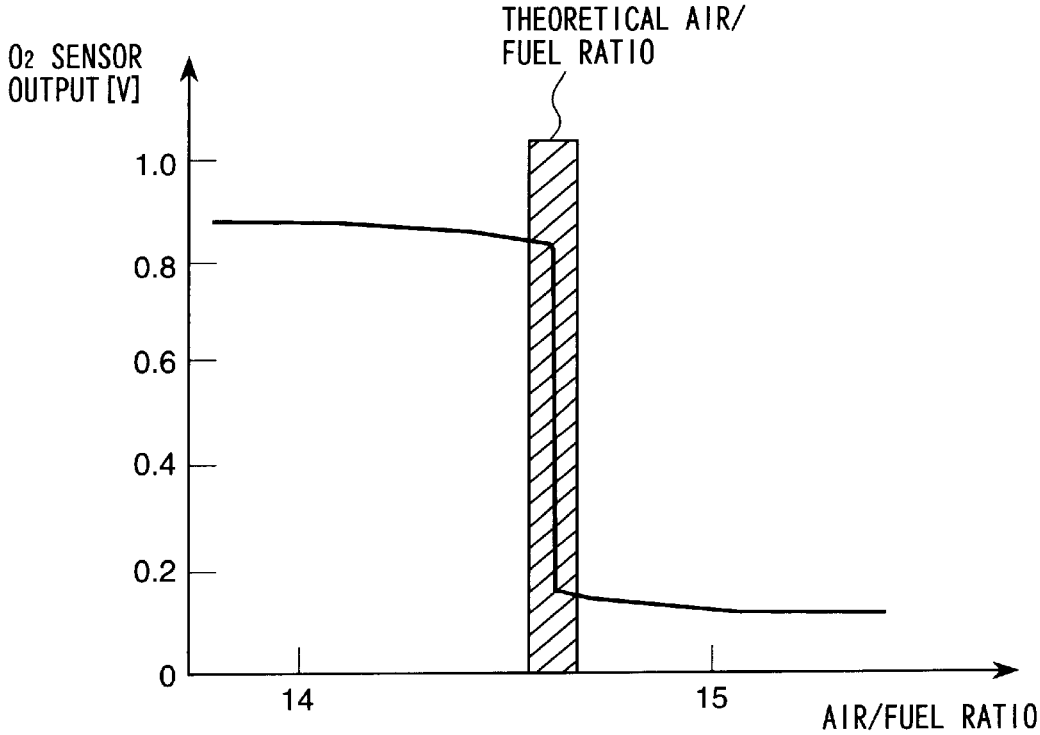
FIG. 21 is a graph showing output characteristics of an $O_2$ sensor with respect to the air/fuel ratio.
Figure 22:
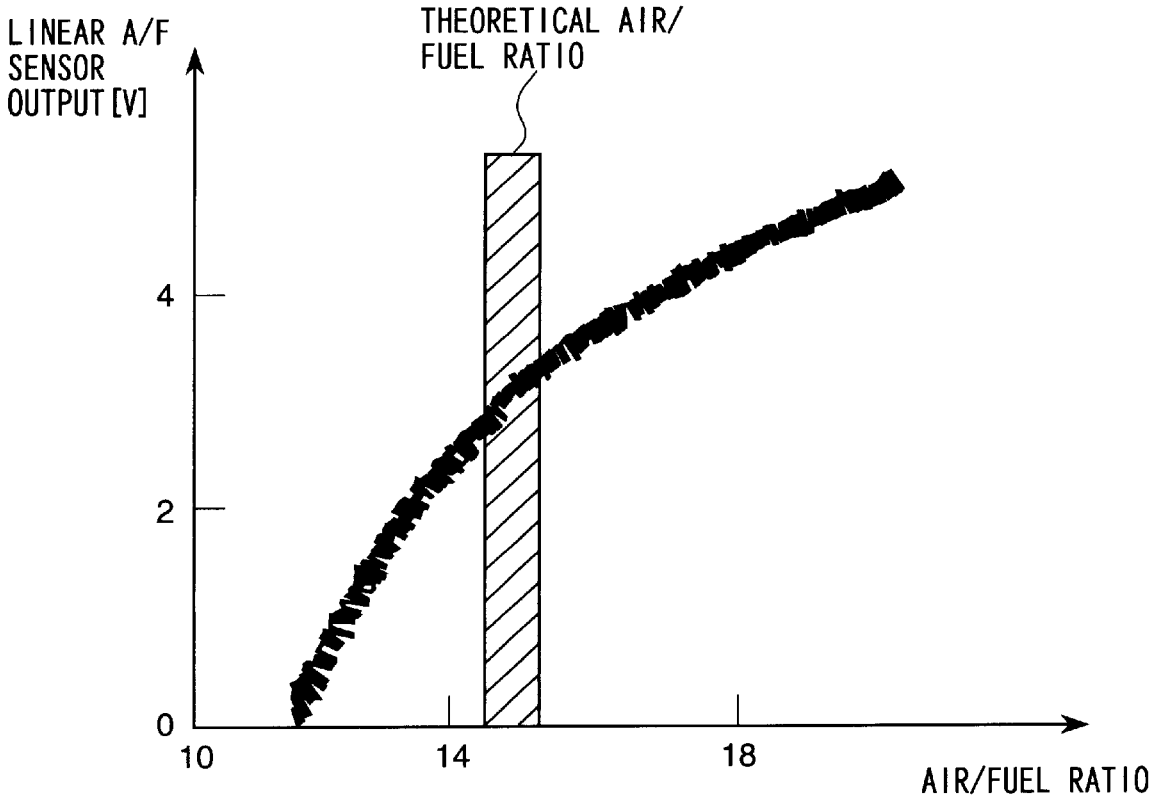
FIG. 22 is a graph showing the output characteristics of a linear A/F sensor with respect to the air/fuel ratio.

FIGS. 18 and 19 show other embodiments of the engine control apparatus and self-diagnosis apparatus according to the present invention. Additionally, in FIGS. 18 and 19, components corresponding to those of FIGS. 1, 3, 14 are denoted with the same reference numerals of FIGS. 1, 3, 14, and description thereof is omitted.

The embodiment shown in FIG. 18 includes cylinder air/fuel ratio control means 50 for controlling the air/fuel ratio of each cylinder of the engine 10, amplitude detection means 51 for detecting the amplitude of the signal (detected air/fuel ratio) obtained from the linear A/F sensor 28 as the air/fuel ratio detection means under air/fuel ratio control under which the air/fuel ratio of each cylinder is non-uniform, A/F sensor response characteristics detection means 52 for detecting the response characteristics of the linear A/F sensor 28 from the air/fuel ratio amplitude detected by the amplitude detection means 51, and engine control response characteristics detection means 53 for detecting engine control response characteristics of the air/fuel ratio control system from the air/fuel ratio amplitude detected by the amplitude detection means 51.

In the embodiment, while the air/fuel ratio of each cylinder is controlled to be non-uniform, the response characteristics of the linear A/F sensor or the engine control response characteristics of the air/fuel ratio control system can be detected from the air/fuel ratio amplitude detected by the amplitude detection means 51.

The embodiment shown in FIG. 19 includes cylinder air/fuel ratio control means 50 for controlling the air/fuel ratio of each cylinder of the engine 10, frequency component detection means 54 for detecting the frequency component of the signal (detected air/fuel ratio) obtained from the linear A/F sensor 28 as the air/fuel ratio detection means while the air/fuel ratio of each cylinder is controlled to be non-uniform, linear A/F sensor response characteristics detection means 55 for detecting the response characteristics of the linear A/F sensor 28 from the air/fuel ratio frequency component detected by the frequency component detection means 54, and engine control response characteristics detection means 56 for detecting the engine control response characteristics of the air/fuel ratio control system from the air/fuel ratio frequency component detected by the frequency component detection means 54.

In the embodiment, while the air/fuel ratio of each cylinder is controlled to be non-uniform, the response characteristics of the linear A/F sensor or the engine control response characteristics of the air/fuel ratio control system can be detected from the air/fuel ratio frequency component detected by the frequency component detection means 54.

As described above, according to the engine self-diagnosis apparatus of the present invention, since the response characteristics of the air/fuel ratio detection means or the engine response characteristics can be detected a plurality of times in the broad operation conditions, remarkably high-precision diagnosis is possible.

Moreover, according to the engine control apparatus of the present invention, the engine operation state can appropriately be controlled based on the detection results of the response characteristics of the air/fuel ratio detection means and engine by the self-diagnosis apparatus.

What is claimed is:

1. An engine self-diagnosis apparatus comprising:

means for controlling an air/fuel ratio of each cylinder of a multiple cylinder engine;

air/fuel ratio detection means emitting an output which is proportional to an air/fuel ratio of an exhaust tube assembly;

means for controlling the air/fuel ratio of each cylinder to be non-uniform; and means for detecting response characteristics of said air/fuel ratio detection means or response characteristics of engine control from an amplitude of a signal obtained from said air/fuel ratio detection means under control under which the air/fuel ratio of each cylinder is non-uniform.

2. The engine self-diagnosis apparatus according to claim 1 wherein the response characteristics of the air/fuel ratio detection means or the response characteristics of the engine control are detected from a signal amplitude based on an engine rotation number in response to the signal obtained from the air/fuel ratio detection means.

3. The engine self-diagnosis apparatus according to claim 1, further comprising means for judging that the response characteristics of the air/fuel ratio detection means are abnormal when the amplitude of the signal obtained from the air/fuel ratio detection means indicates a predetermined value or less.

4. The engine self-diagnosis apparatus according to claim 1 wherein a fuel property is detected from the amplitude of the signal obtained from the air/fuel ratio detection means when the engine cools down.

5. The engine self-diagnosis apparatus according to claim 3, further comprising means for informing that the response characteristics of the air/fuel ratio detection means are judged to be abnormal.

6. An engine control apparatus comprising: the engine self-diagnosis apparatus according to claim 3; and means for stopping control performed based on a signal obtained from air/fuel ratio detection means when it is judged that the response characteristics of the air/fuel ratio detection means are abnormal.

7. An engine control apparatus comprising: the engine self-diagnosis apparatus according to claim 1; and means for controlling an engine operation parameter based on response characteristics of air/fuel ratio detection means or response characteristics of engine control.

8. The engine self-diagnosis apparatus according to claim 3, wherein the response characteristics of the air/fuel ratio detection means or the response characteristics of the engine control are detected from a signal amplitude based on an engine rotation number in response to the signal obtained from the air/fuel ratio detection means.

9. The engine self-diagnosis apparatus according to claim 4, further comprising means for judging that the response characteristics of the air/fuel ratio detection means are abnormal when the amplitude of the signal obtained from the air/fuel ratio detection means indicates a predetermined value or less.

10. An engine self-diagnosis apparatus comprising:

means for controlling an air/fuel ratio of each cylinder of a multiple cylinder engine;

air/fuel ratio detection means for emitting an output which is proportional to an air/fuel ratio of an exhaust tube assembly;

means for controlling the air/fuel ratio of each cylinder to be non-uniform; and means for detecting response characteristics of said air/fuel ratio detection means or response characteristics of engine control from a frequency component of a signal obtained from said air/fuel ratio detection means under control under which the air/fuel ratio of each cylinder is non-uniform.

11. The engine self-diagnosis apparatus according to claim 10 wherein the response characteristics of the air/fuel ratio detection means or the response characteristics of the engine control are detected from the frequency component based on an engine rotation number in response to the signal obtained from the air/fuel ratio detection means.

12. The engine self-diagnosis apparatus according to claim 10 wherein the response characteristics of the air/fuel ratio detection means or the response characteristics of the engine control are detected from a power of the frequency component in a predetermined phase range based on the engine rotation number in response to the signal obtained from the air/fuel ratio detection means.

13. The engine self-diagnosis apparatus according to claim 12, further comprising means for judging that the response characteristics of the air/fuel ratio detection means are abnormal when the power of the frequency component in the predetermined phase range based on the engine rotation number indicates a predetermined value or less in response to the signal obtained from the air/fuel ratio detection means.

14. The engine self-diagnosis apparatus according to claim 10 wherein a fuel property is detected from the frequency component of the signal obtained from the air/fuel ratio detection means when the engine cools down.

15. The engine self-diagnosis apparatus according to claim 13, further comprising means for informing that the response characteristics of the air/fuel ratio detection means are judged to be abnormal.

16. The engine self-diagnosis apparatus according to claim 14, further comprising means for informing that the response characteristics of the air/fuel ratio detection means are judged to be abnormal.

17. The engine control apparatus comprising:

the engine self-diagnosis apparatus according to claim 10, and means for controlling an engine operation parameter based on response characteristics of air/fuel ratio detection means or response characteristics of engine control.

* * * * *